United States Patent [19]

Shaver et al.

[11] Patent Number: 4,561,599

[45] Date of Patent: Dec. 31, 1985

[54] MILL LOAD SENSING SYSTEM

[75] Inventors: Marvin B. Shaver, Beaconsfield, Canada; Rhual L. Guerguerian, Marietta, Ga.

[73] Assignee: Dominion Engineering Works Limited, Lachine, Canada

[21] Appl. No.: 552,401

[22] Filed: Nov. 16, 1983

[51] Int. Cl.[4] ..... B02L 17/24

[52] U.S. Cl. ..... 241/34; 73/862.49; 241/171; 241/175

[58] Field of Search ..... 241/34, 35, 36, 37, 241/171, 179, 175; 51/164 R; 73/862.49

[56] References Cited

U.S. PATENT DOCUMENTS

| | | | |
|---|---|---|---|
| 3,027,553 | 3/1962 | Sandor | 73/862.49 X |
| 3,308,657 | 3/1967 | Kus | 73/862.49 |
| 3,471,094 | 10/1969 | Kearney et al. | 241/34 X |

FOREIGN PATENT DOCUMENTS 791424 8/1968 Canada .

*Primary Examiner*—Howard N. Goldberg
*Assistant Examiner*—T. Eley
*Attorney, Agent, or Firm*—Raymond A. Eckersley

[57] ABSTRACT

There is disclosed a system for sensing and controlling the mill load in a grinding mill. The system includes a load cell located in the region of the mill that is subjected to reaction axial thrust forces developed during mill operation. The load cell senses the thrust forces and provides output signals representative of the values of the thrust forces. The system further includes a load controller which is responsive to the output signals for determining the charge load of the mill and for providing control signals to the mill so as to control entry of materials into the mill.

7 Claims, 3 Drawing Figures

MILL LOAD SENSING SYSTEM

FIELD OF THE INVENTION

The present invention relates to a mill load sensing system for sensing and controlling the charge load in a mill during operation of the mill.

BACKGROUND OF THE INVENTION

In order to achieve the optimum grinding efficiency for a grinding mill, the mass of the charge load in the mill must be of a predetermined value which is dependent upon the run-of-mine for an autogeneous mill (i.e., the material entering the mill) or the grinding media for a ball, rod or pebble mill. Presently, no system has been developed which can reliably determine the charge load in the mill.

Attempts have been made in the past to relate the mill charge load to the bearing pressure of the trunnion bearing supporting the trunnion of the mill. One such attempt is disclosed in Canadian Pat. No. 791,424, issued Aug. 6, 1968 to Harris et al. These attempts have not been reliable, however, because the liner in the mill is continuously wearing, whereby the mill weight is constantly varying. Also, it should be understood that 40 to 60 percent of the loading, due to gravity, placed on the trunnion bearing, is due to the weight of the grinding mill. Hence, any reading taken of loading on the trunnion bearing, cannot be accurately measured and related to charge load in the mill, because fluctuations in the grinding mill weight are largely responsible for trunnion bearing load changes.

BRIEF DESCRIPTION OF THE INVENTION

It is therefore a feature of the present invention to provide a mill load sensing system for sensing the charge load in a mill.

Briefly, a mill load sensing system is provided that includes a helical gear means assembled in secured relation with a rotatable drum of the mill. The helical gear means is driven by the pinion of a prime mover for the mill. The helical gear means during mill operation, develops reaction axial thrust forces, the values of which are substantially a function of the charge load in the mill. At least one sensing means is located in a region of the mill that is subjected to the axial thrust forces. The sensing means senses the thrust forces and provides output signals which are representative of the value of these thrust forces. The system further includes a load control means responsive to the output signals for determining the charge load in the mill and for providing control signals to the mill so as to control entry of materials into the mill.

By sensing directly to indirectly axial thrust forces developed during mill operation, the system of the present invention senses a force which is proportional to the charge load of the mill. It should be understood that there is some predetermined error in this system which is due to the friction of the mill. It is to be expected that the mill will provide for about 2% of the total value of the developed axial forces, as this value is the amount of axial force that is produced during operation of the mill under no load condition. This measurement of charge load, however, is of improved accuracy over previously unreliable methods of sensing charge load.

In a system of the present invention, it is envisaged that the sensing means need only be located in the region of the mill that is subjected to axial thrust forces.

Such regions exist in various areas of the mill such as, for example, a trunnion bearing pocket and a bearing pocket of the pinion and/or the prime mover. Also, it should be understood that the sensing means may be located in more than one region. As can be appreciated, most large grinding mills are driven by two prime movers which operate in synchronism. Thus, the sensing means may be located at bearing pockets for each of these prime movers. The sensing measn may further comprise a load cell such as, for example, a hydraulic jack or a piezo electric load cell.

Regarding gear drives for such grinding mills, some gear drives may include a gear reduction unit between the pinion and prime mover. In this case and in the case where no gear reduction unit is employed, the coupling of the pinion to prime mover does not normally transmit axial forces related to the developed axial thrust forces. Rather, one of the pinion bearings would be arranged to accept the axial related forces and provide through the sensing means the output signals.

Although the present invention is described with regard to its application with a grinding mill, it should be understood that such has been done for the purposes of illustration only; and that, without departing from either the scope or spirit of the invention, it may be applied to other types of machines in which the charge load of the machine develops axial thrust forces proportional thereto. Accordingly, reference hereafter in the disclosure and claims to the term "mill" shall mean a machine as described hereinabove.

Therefore, in accordance with a broad aspect of the present invention, there is provided a mill load sensing system for sensing the charge load in a mill. The system comprises a helical gear means operably with rotatable drum of the mill and being driven by a pinion of a prime mover of the mill. The helical gear means develops axial thrust forces, the values of which are substantially a function of the charge load in the mill. The system further comprises at least one sensing means located in a region of the mill that is subjected to the axial thrust forces. The sensing means senses the thrust forces.

BRIEF DESCRIPTION OF THE DRAWINGS

For a better understanding of the nature and objects of the present invention, reference may be had, by way of example, to the accompanying diagrammatic drawings in which.

DESCRIPTION OF THE PREFERRED EMBODIMENT

Figure 1:
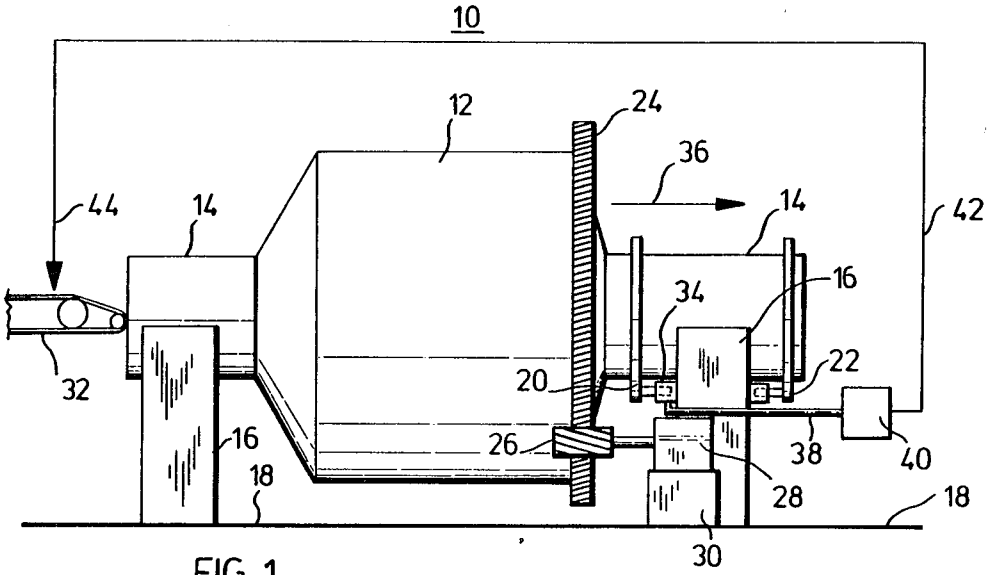
FIG. 1 is a schematic representation of a grinding mill and the mill load sensing system therefore.

Referring to FIG. 1 the preferred embodiment of the present invention is described. A grinding mill 10 is provided with a rotatable drum structure 12. Drum structure 12 is rotatable about trunnions 14 which are mounted by trunnion bearings 16 above floor 18. One of the trunnions 14 is provided with shoulder 20 and 22 so as to limit the axial displacement of the drum structure 12. Secured to the drum structure 12 is a single helical gear 24 which is driven by pinion 26 having its helical teeth in accurate meshing relation with the teeth of the helical gear 24. Pinion 26 is shown attached via a shaft to an electric prime mover 28 mounted above the floor 18 by foundation support 30.

During mill operation material, and possible water, is transported by conveyor belt 32 to one of the trunnions 14 of mill 10. Friable material entering drum structure 12 is ground within the mill and discharged through the other trunnion 14 to another conveyor belt (not shown). In order to control the charge load within the drum structure 12, a sensing means schematically indicated at 34 is provided in a trunnion bearing pocket between shoulder 20 and one of the trunnion bearings 16. The sensing means 34 may comprise a hydraulic load cell which senses the axial thrust forces developed by the mill 10 during operation. Arrow 36 depicts the axial direction in which the axial forces will be developed.

Line 38 is a schematic representation of an output path from the hydraulic load cell 34 which runs into a load control means 40. The hydraulic load cell 34 senses the thrust forces and transmits output signals represntative of the values of these trust forces along output path 38. The load control means 40 is responsive to the output signals for determining the charge load in the mill and providing control signals which are representative of the charge, to control entry of materials into the mill. The control of materials entering the mill by control means 40 is shown schematically by line 42 terminating in arrow 44 at conveyor 32. This may involve either automatically or manually controlling the rate of movement of the conveyor 32.

The control means 40 in response to the ouput signals determines the charge load by averaging a predetermined number of output signals from the sensing means. The control means compares the average of the predetermined number of output signals with a predetermined reference signal which provides a control signal that is indicative of whether the load in the mill is increasing or decreasing. The control means may further be provided with a memory storage means so that each previous average of the output signals may be averaged. The stored output signals may comprise the predetermined reference signal with which the newly determined average signals will be compared. As the electronic components for this function are well known in the art, these components are not shown.

Figure 2:
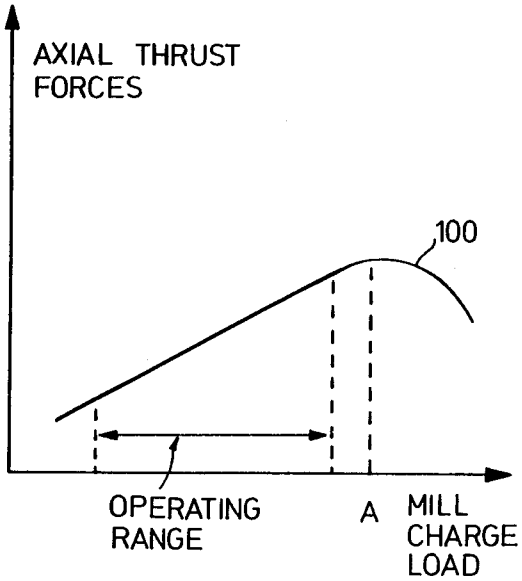
FIG. 2 is a graph showing the relationship between the mill charge load and axial thrust forces; and, FIG. 3 is a partial schematic representation of an alternate mill load sensing system for a grinding mill.

Referring to the graph of FIG. 2, there is shown a curve 100 which illustrates the functional relationship between the axial thrust forces and the mill change load from FIG. 2 the relationship is shown to be one to one over the operating range of the mill; however, this relationship ceases after the charge load in the mill exeeds a predetermined value indicated at "A" on the graph. As shown, the predetermined value "A" is just beyond the upper limit of the preferred operating range and in some instances may define the upper operating limit. It should be understood that this predetermined value is normally a known value for which the machine control system can readily monitor through the sensing means. In the case of the predetermined value not being a know parameter, it can be detected after it is exceeded when the values of axial thrust forces decrease as a result of an increase in the feed rate of material entering the mill. Thus the control means 40 in the preferred embodiment further provides a warning indication when the resultant forces decrease as a result of an increase in the feed rate of material entering the mill.

Figure 3:
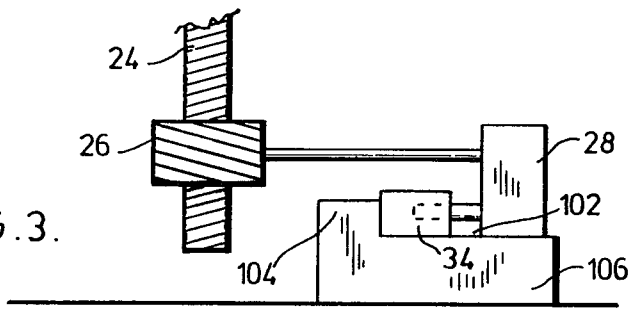

Referring to FIG. 3 an alternate embodiment for the present invention is shown. In FIG. 3 the hydraulic load cell 34 is shown located in a pocket 102 between prime mover 38 and flange portion 104 of foundation 106. This embodiment is illustrated to show the positioning of the hydraulic load cell in a region other than that shown in FIG. 1. It is to be understood that load cell 34 indirectly senses the axially thrust forces.

It should be understood that alternate embodiments may be readily apparent to a man skilled in the art in view of the foregoing description of the present invention. For example, the conveyor 28 illustrated in FIG. 1 may not be employed. In this instance, the mill may be loaded by other means and the control signal indicates that the mill is to be charged. Accordingly, the scope of the present invention should only be limited to that which is claimed in the accompanying claims.

What we claim as new and desire to secure by Letters Patent of the United States of America is:

1. A mill load sensing system for sensing the charge load in a mill rotating about an axis, said system comprising:

helical gear means operable with a rotatable drum of said mill and being driven by a pinion of a prime mover of said mill, said helical gear means during mill operation developing axial thrust forces;

the values of which are substantially a function of the charge load in the mill, said axial thrust forces being substantially parallel to said axis; and at least one sensing means located in a region of said mill in a position to sense forces representative of said thrust forces, said sensing means providing output signals representative of the values of said thrust forces; and load control means responsive to said output signals for determining the charge load in said mill and for providing control signals to said mill whereby said control signals control entry of materials into said mill.

2. The system of claim 1 wherein said sensing means comprises a load cell.

3. The system of claim 2 wherein said load cell comprises a hydraulic jack.

4. The system of claim 1 wherein said control means, in response to said output signals determines said load by averaging a predetermined number of said output signals.

5. The system of claim 4 wherein said control means provides each of said control signals after comparing the average of the predetermined number of output signals with a predetermined reference signal.

6. The system of claim 5 wherein said predetermined reference signal comprises previous average of said output signals.

7. The system of claim 1 wherein said control means further provides a warning indication when the thrust forces decrease after an increase in the feed rate of material entering the mill.

* * * * *